United States Patent [19]

Dye et al.

[11] 3,938,262

[45] Feb. 17, 1976

[54] LASER WEAPON SIMULATOR

[75] Inventors: Richard A. Dye, Santa Barbara; Donald A. Rowley, Goleta, both of Calif.

[73] Assignee: Hughes Aircraft Company, Culver City, Calif.

[22] Filed: Oct. 17, 1974

[21] Appl. No.: 515,809

[52] U.S. Cl. ..... 35/25

[51] Int. Cl.[2] ..... F41G 3/06

[58] Field of Search ..... 35/25; 273/101.1; 331/94.5 P, DIG. 1; 250/212; 340/213, 416

[56] References Cited

UNITED STATES PATENTS 3,633,285 1/1972 Sensney ..... 35/25

3,657,826 4/1972 Marshall et al. ..... 35/25

*Primary Examiner*—John H. Wolff

*Attorney, Agent, or Firm*—W. H. MacAllister, Jr.; R. A. Cardenas

[57] ABSTRACT

A realistic laser weapon simulator is disclosed which utilizes a laser transmitter in combination with a rifle for teaching marksmanship by firing laser "bullets" at an infrared detector equipped target. The laser weapon includes a piezoelectric crystal coupled to a laser in a housing for mounting axially to a rifle barrel. The rifle may develope a mechanical force by firing a blank cartridge which generates a shock wave and vibrates the piezoelectric device. A mechanical force may also be applied directly to the piezoelectric device by the rifle's hammer.

4 Claims, 7 Drawing Figures

LASER WEAPON SIMULATOR

FIELD OF THE INVENTION

This invention relates generally to a marksmanship training device. In particular, this invention relates to a laser transmitter for use in combination with a rifle for firing laser "bullets" in response to a blank cartridge being fired.

DESCRIPTION OF THE PRIOR ART

Systems using semiconductor GaAs lasers have been developed to train military personnel in using the M-16 rifle. A laser transmitter has been used in conjunction with an M-16 rifle for firing at infrared-sensor-equipped targets which score a hit whenever a laser bullet strikes the detector. Prior art systems utilize a laser transmitter which is attached under the barrel of an M-16 rifle. External batteries are used to power the laser transmitter in response to the trigger being pulled. The total weight of the laser transmitter, power supply and controls for the laser transmitter is approximately six pounds. A drawback of such a system is that the battery pack and some of the controls for the laser are carried on a soldier's person and connected to the rifle by cumbersome cables. Another drawback of the prior art systems is the alignment procedure that should be performed to accurately sight the laser transmitter. Since the laser attaches under the rifle barrel, a time-consuming and tedious alignment procedure must be carried out in order that the laser transmitter be accurately sighted. In addition, the controls connecting the rifle trigger with the laser transmitter have a tendency to provide false trigger signals due to circuit malfunctions. There is also the problem of providing the proper synchronization between pulling the trigger and emitting an output signal.

SUMMARY OF THE INVENTION

Accordingly, it is the object of the present invention to provide a simple, reliable, accurate, and economical laser weapon simulator for use as a training aid to develop marksmanship.

It is another object of the present invention to provide a laser weapon simulator that is accurately and automatically sighted.

It is another object of the present invention to provide a lightweight laser weapon simulator requiring no external electrical power.

It is yet another object of the present invention to provide a laser weapon simulator that is realistic by providing a report and recoil.

In accordance with the foregoing objects, a laser weapon simulator according to the present invention includes a laser transmitter to which power is supplied by exciting a piezoelectric crystal. The laser transmitter is contained in a housing that is axially disposed on the rifle barrel for accurate bore sighting. The energy from the piezoelectric crystal is stored in an energy storage device and then discharged through a semiconductor laser device in response to a control signal. The laser device provides an output pulse as a result of the storage device being discharged.

DETAILED DESCRIPTION OF THE DRAWINGS

Figure 1:
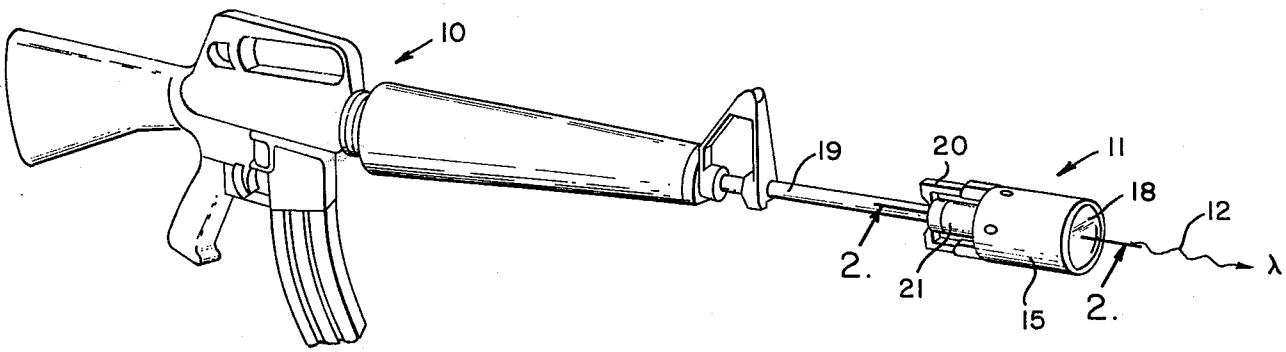
FIG. 1 is a perspective view of a rifle with a laser weapon simulator attached.

Referring more specifically to FIG. 1, a rifle 10 and a laser weapon simulator 11 are depicted for firing a laser "bullet" or output pulse 12, in response to a blank cartridge 13 (not shown), being fired. The laser weapon simulator 11 includes a muzzle alignment shaft 14 (not shown here) connected to a housing member 15. The housing member 15 encloses a piezoelectric ceramic 16 (not shown), laser transmitter circuitry 17 (not shown) and optics 18.

The muzzle alignment shaft 14 is a tubular shaped member that mounts into the barrel 19 of a weapon, such as an M-16 rifle 10 and thereby provides automatic bore sight alignment. Pawls 20 are attached to the housing member 15 and secure the simulator 11 to the rifle 10 by clamping onto the flash suppressor 21. Alternatively, the muzzle alignment shaft may be designed such that it fits around the barrel 19.

If the proper manufacturing tolerances are maintained, the laser weapon simulator 11 is automatically bore sighted to the weapon 11. The heretofore time consuming and tedious alignment procedures, necessary for prior art simulators, are eliminated.

To operate the laser weapon simulator 11 one need only insert the simulator 11 into the barrel of the rifle 10 and load a blank cartridge into the breach. The laser transmitter circuit causes a laser "bullet" 12 to be fired in response to the blank cartridge 13 being fired. The laser "bullet" may be an energy pulse, such as infrared signal. A hit would be registered if the "bullet" strikes an infrared detector (not shown). A more detailed explanation of the invention is found below.

Figure 2:
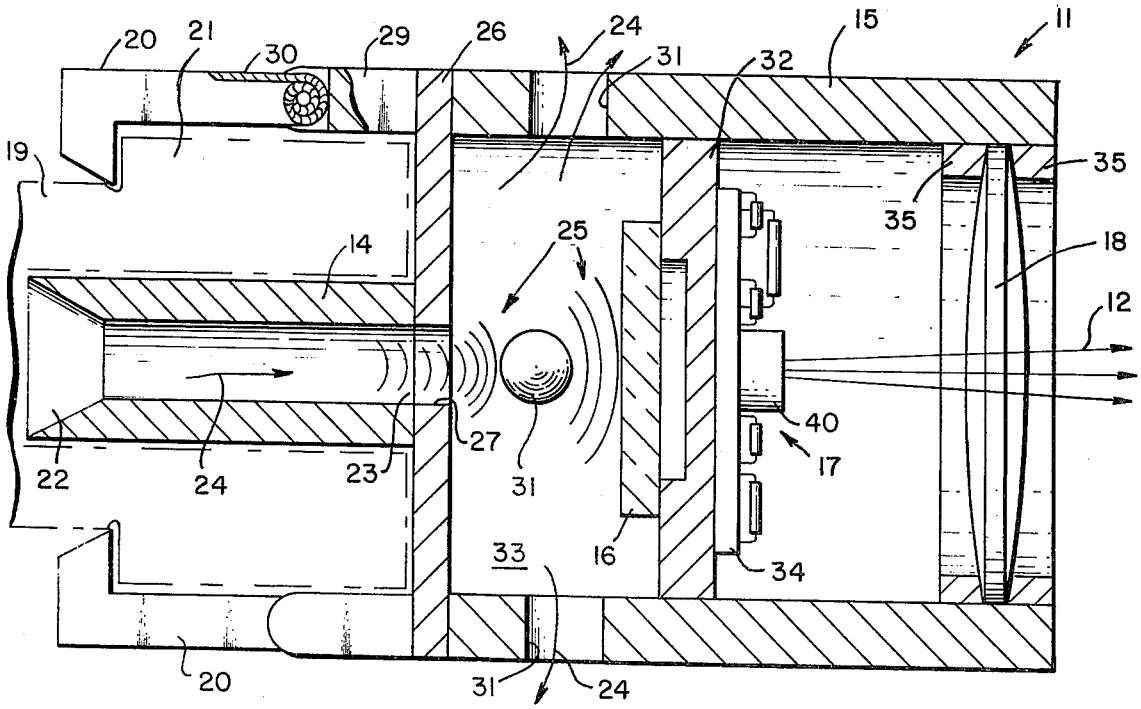
FIG. 2 is longitudinal sectional view of a first embodiment of the present invention according to FIG. 1.
Figure 4:
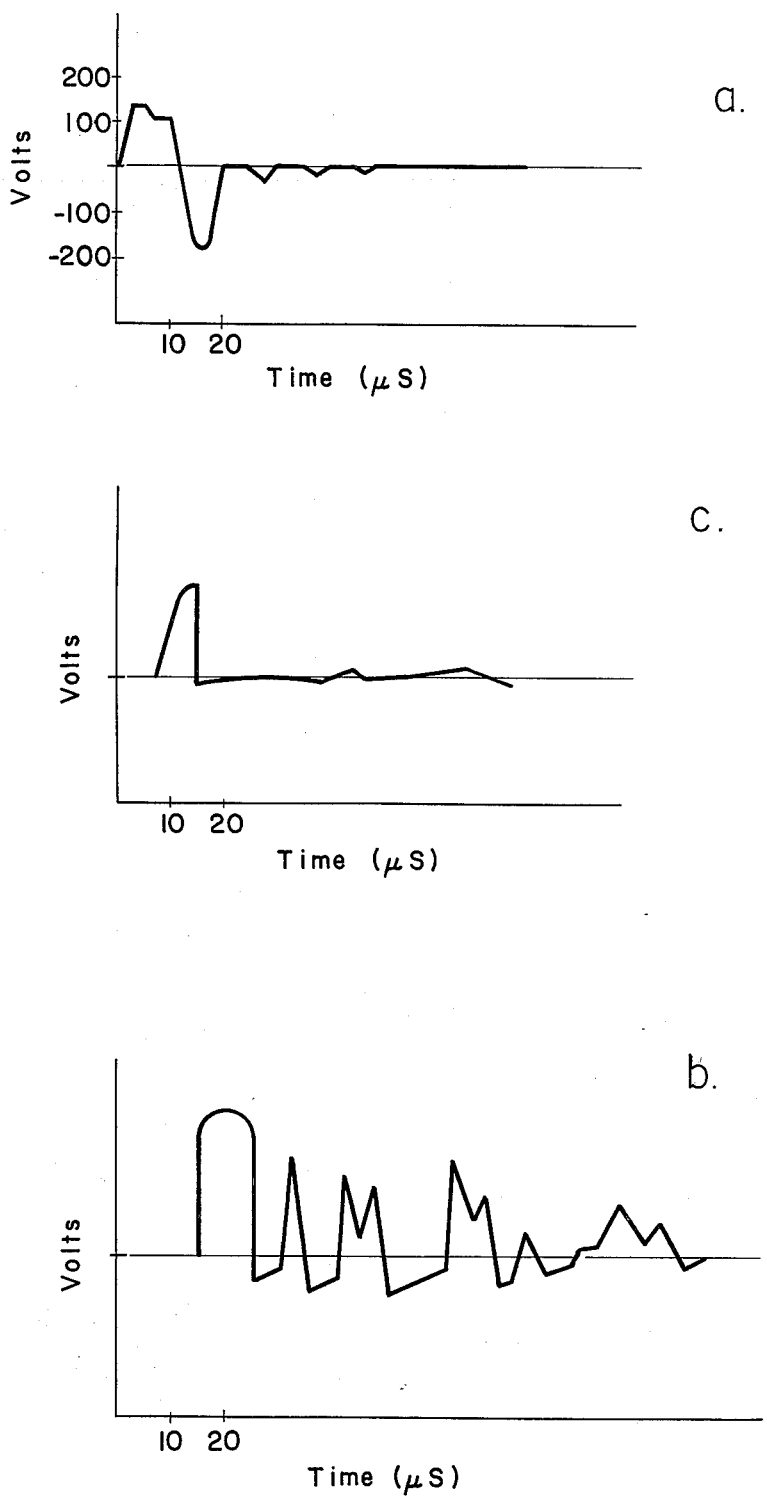
FIGS. 4*a*–4*c* are waveform diagrams representing voltages at various points in the circuit according to FIG. 3.

Referring more specifically to FIG. 2, a laser weapon simulator 11 according to the present invention may be seen to include a muzzle alignment shaft 14, a housing member 15, a piezoelectric ceramic 16 a laser transmitter circuit 17 and optics 18. The muzzle alignment shaft 14 is a tubular member having entry and exit ports 22 and 23, respectively, for conveying gasses 24 and shock waves 25 from a blank cartridge being fired. The entry port 22 may be countersunk for providing a smooth transition for the gasses 24 and the sound wave 25 as they pass from the rifle barrel 19 to the muzzle alignment shaft 14.

A cylindrically shaped housing member 15 has an end plate 26 with a centrally located opening 27. The muzzle alignment shaft 14 and the housing member 15 are axially connected at the exit port 23 and the opening 27, respectively. Hinge support members 29 are connected to end plate 26. The pawls 20 are connected to the hinge support members 29 by spring loaded hinges 30. Several openings 31 are located about the circumference of the housing member 15 near the end plate 26. The opening 31 allow the spent gasses 24 to escape from the rifle barrel 19 through the chamber 33.

A support member 32 is disposed with the housing 15 and forms one surface of a chamber 33. The support member 32 mounts a piezoelectric device, such as a crystal 16 within the chamber 33. The crystal 16 is aligned with the exit port 23 so that the shock wave 25 strikes the proximate center of the crystal 16. The mechanical force of the sound wave 25 is converted into electrical energy by the crystal 16. Thus the piezoelectric crystal 16 provides a source of power to operate the transmitter circuit 17.

A circuit board 34, having the electronic components for the laser transmitter circuit 17, may be mounted onto the other face of the support member 32. A laser transmitter such as a GaAs laser diode 40, for example, is mounted on the circuit board 34 in axial alignment with the muzzle alignment shaft 14.

Optics, such as a collomating lens 18, may be mounted at the output end of the laser weapon simulator 11 for properly directing the output pulse 12 from the laser transmitter 40. The lens 18 is supported in place by first and second annular members 35 placed on opposite faces of the lens 18.

The operation of the invention according to FIG. 2 is now described. The magazine of the weapon 10 is loaded with a preselected number of blank cartridges 13. Firing the cartridge 13 generates a mechanized shock wave 25 which strikes the crystal 16 causing it to oscillate and to provide electrical energy to the laser transmitter circuit 17. The laser diode 40 emits an infrared output pulse 12. If the output pulse 12 strikes an infrared detector that is coupled to suitable circuitry, a hit is scored. The spent gasses 24 are expelled from the chamber 26 through the openings 27. A more detailed discussion of the operation of a laser transmitter circuit 16 is found below.

As discussed above, there is no manual alignment necessary since the laser weapon simulator 11 is automatically bore sighted to the rifle 10. Also, there is realism since there is a report whenever a laser "bullet" is fired. There is no synchronization problem that exists with prior art systems since a "bullet" is fired only when a blank cartridge is fired.

Figure 3:
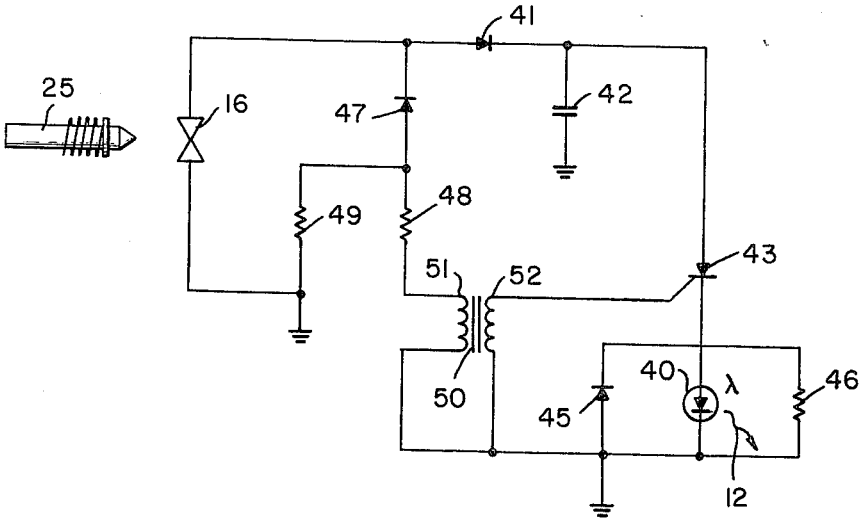
FIG. 3 is a schematic circuit diagram of a laser transmitter.

Referring more specifically to FIG. 3, a circuit diagram of a laser transmitter circuit 17 according to the invention of FIG. 1 is now described. A piezoelectric ceramic 16 provides a source of electrical power to laser transmitter circuit 17 which causes a laser diode 40 to provide an output signal 12 in response to a mechanical input signal 25. A first electrode of the crystal 16 is coupled to ground and a second electrode is coupled to the anode electrode of a first diode 41. A storage capacitor 42 is coupled between the cathode electrode of the diode 41 and ground. The capacitor 42, upon being charged by the crystal 40 provides a source of current to the laser diode 40. The cathode electrode of the diode 41 is also coupled to the anode electrode of a silicon controlled rectifier (SCR) 43. The control electrode of the SCR 43 controls the current path formed by the anode and cathode electrodes. A laser diode 40 is connected between the cathode electrode of the SCR 43 and ground. A second diode 45 is connected in parallel with the laser diode 44 with the cathode of the diode 45 being connected to the anode of the laser diode 40. The diode 45 clamps any reverse voltage across the laser diode 40 to about 1 volt and thereby prevents any damage to that diode. A resistor 46 is also connected in parallel with the laser diode 44.

The cathode electrode of a third diode 47 is connected to the second electrode of the piezoelectric crystal 16. The anode electrode of the diode 47 is connected to first electrodes of resistors 48 and 49. The second electrode of the resistor 49 is connected to ground.

A transformer 50 is coupled between the third diode 47 and the gate electrode of the SCR 43. The primary winding 51 is connected between the second electrode of the resistor 48 and ground. The secondary winding 52 is connected between the gate electrode of the SCR 43 and ground. The transformer 50 isolates the gate electrode from the piezoelectric crystal 16 and also steps down the voltage.

The operation of the circuit according to FIG. 3 is now described with respect to that figure and with respect to FIGS. *4a–4c*. A mechanical force, such as the shock wave 25 created by a blank cartridge being fired, is applied to the piezoelectric crystal 16 causing that crystal to provide an output signal as illustrated in FIG. *4a*. It is noted that the output signal is an AC waveform since the crystal 16 may "ring" as a result of the mechanical force. During the positive half cycle of the output signal from the crystal 16, the diode 41 is forward biased thereby charging the storage capacitor 42 to the voltage level generated by the crystal 16. During the positive half cycle the SCR 43 is not conducting.

During the negative half cycle output signal from the crystal 16, the diode 47 is forward biased which induces a current flow through the primary 51 of the transformer 50. The secondary winding 52 provides an output signal to the gate of the SCR 43 which places it in conduction. The waveform of the signal to the gate of the SCR 43 is illustrated in FIG. *4b*. It should be noted that the output signal from the transformer 50 is also an AC signal which is also caused by the "ring" of the crystal 16.

Referring now to FIG. *4c*, the SCR 43, in response to the signal on the control gate, discharges the storage capacitor 42, almost instantaneously, through the GaAs laser 40 and thereby produces an infrared output pulse 12.

The following embodiments having the same elements as any preceding embodiment will have the reference designation number and those numbers will be prefixed by the numeral 1.

Referring more specifically to FIG. *5a*, a second embodiment of the present invention utilizes a piezoelectric crystal 116 that is contained within the breach of a rifle 110, not herein shown.

A cartridge-shaped member 60 has openings 61 and 62 at what would normally be the primer end and the bullet end, respectively, of a normal cartridge. An end cap 63 distance away from the primer end 61. The end cap 63 is a circular plate with a small opening at the center. A plunger 64 is mounted onto the end cap 63 and an extension of the plunger 64 protrudes through the small opening in the end cap 63. A circular flat spring 65 connects the end cap 63 and the plunger 64 to the cartridge 60. The spring 65 has an opening at the center through which a portion of the plunger 64 protrudes. The spring 65 is bowed slightly and fits within the cartridge 60, next to the lip about the opening 61.

A piezoelectric device device such as a ceramic or crystal 116 is mounted within the cartridge 60 with one face of the crystal 116 resting against the spring 65. Wire leads 66 and 67 extend from the device 160 and are connected to a female connector 71 mounted at the bullet end 62 of cartridge member 60. A female electrical connector 71 is mounted at the opening 62. A washer 69 is disposed next to the second face of the crystal 116. A helical compression spring 70 is disposed next to the washer 69 for maintaining the crystal 116 in position. The spring 70 compresses upon the hammer striking the plunger 64 which in turn strikes the crystal 116, thus preventing damage to the crystal.

Figure 5A:
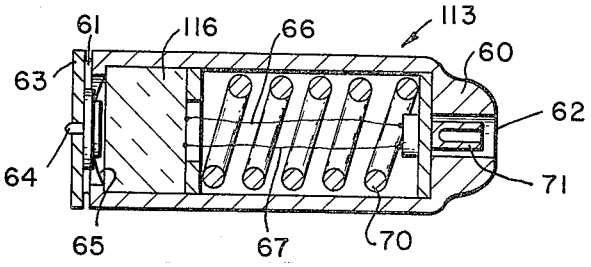
FIGS. 5*a*–5*b* is a longitudinal sectional view of a second embodiment of the present invention.
Figure 5B:
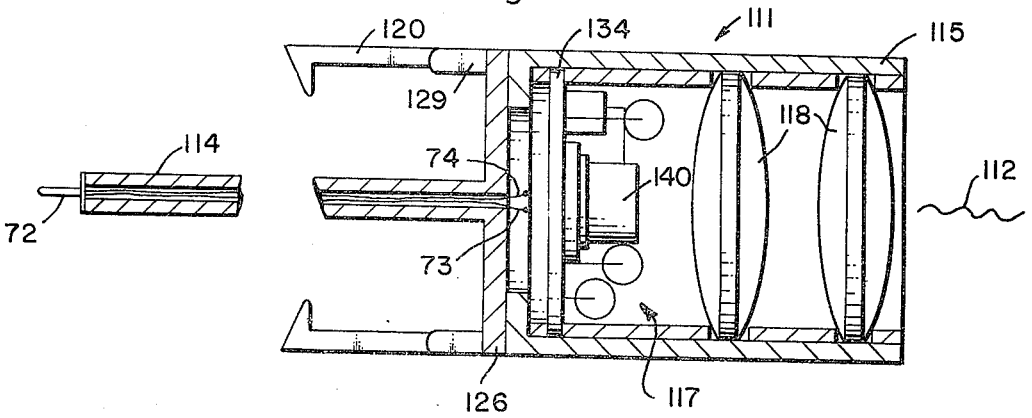

Referring to FIG. 5*b*, the second embodiment of the present invention also includes a laser weapon simulator 11 that is similar to the first embodiment of FIG. 1. Therefore, FIG. 5*b* will not be discussed in detail. The muzzle alignment shaft 114 of the second embodiment is similar to the first embodiment except that the shaft 114 is substantially longer. The shaft 114 extends the length of barrel 117 and connects to the catridge member 60. A male connector electrical connector 72 is mounted at one end of the muzzle alignment shaft 114 for mating with the female connector 71. Wire leads 73 and 74 extend from the connector 72 to the housing member 115 and connect onto the laser transmitter circuit 117. Although two lenses 118 are depicted, the invention may operate with only one.

In operation the second embodiment according to FIG. 5 is now described. The cartridge 113, containing the piezoelectric crystal 116 is placed in the breach of the rifle 110. The muzzle alignment shaft 114 of the laser weapon simulator 111 is inserted into the barrel of the rifle 110. The connectors 71 and 72 make electrical connection between the cartridge 113 and the simulator 111. The bolt is cocked for firing when the trigger is pulled. As the hammer strikes the plunger 64, the plunger in turn strikes the piezoelectric crystal 116 for powering the laser transmitter circuit 117. The laser transmitter circuit 117 of the second embodiment thereupon provides an output pulse 112. The operation of the laser transmitter circuit 117 has been discussed above under FIG. 3 and will not, therefore, be discussed again.

One of the advantages of the invention according to FIG. 5 is that blank cartridges need not be used, making this embodiment more economical to operate. Although there is not the realism of a shot being fired, this embodiment readily lends itself for use in target shooting situations. Although an M-16 rifle with a piezoelectric cartridge in the breach cannot operate in the automatic mode, it can still function by cocking the hammer prior to each shot.

Figure 6:
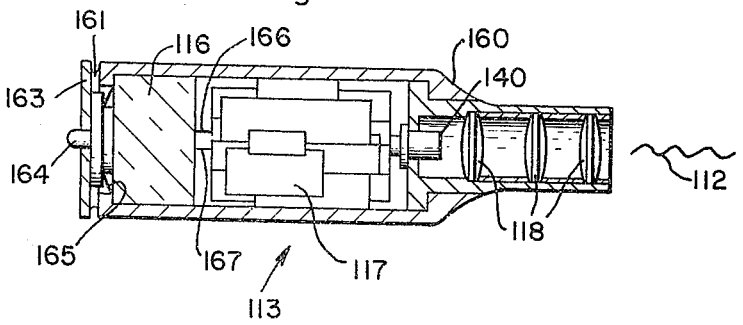
FIG. 6 is a sectional view of a third embodiment of the present invention.

Referring more specifically to FIG. 6, a third embodiment according to the present invention is described. The cartridge shaped member 160 contains a piezoelectric crystal 116, a laser transmitter circuit 117 and optics 118. An end cap 163 and a plunger 164 are mounted at the primer end of the cartridge 113 by a spring 165. The piezoelectric crystal 116 is mounted within the cartridge 113 next to the plunger 164. The laser transmitter circuit 117 is mounted next to the crystal 116 and both are electrically connected together by wire leads 166 and 167. The laser diode 140 is mounted on a support member 80. The output end of the laser diode 140 is axially aligned with the cartridge member 160. Thus the output pulse 112 from the diode 140 is bore sighted to the rifle 110. Three lenses 118 are shown for collomating the output signal from the laser diode 140.

The operation of the third embodiment according to FIG. 6 is similar to the operation of the second embodiment of FIG. 5. Therefore the operation of the third embodiment will not be described.

It should be apparent from the foregoing that the present invention provides a simple, accurate and realistic laser weapon simulator that fires a laser "bullet" in response to a mechanical force being applied to a piezoelectric crystal.

Although the present invention has been shown and described with reference to particular embodiments, nevertheless various changes and modifications obvious to one skilled in the art to which this invention pertains are deemed to lie within the purview of the invention.

What is claimed is:

1. A laser weapon simulation comprising:

piezoelectric means providing the sole source of electrical power and control signals to a laser transmitter in response to the mechanical force generated by the firing pin of a weapon, said piezoelectric means being disposed in the breach of a weapon;

laser transmitter means coupled to said piezoelectric means, said laser transmitter means providing an output signal in response to said power and control signals and being coaxially aligned with the barrel of a weapon; and circuit means coupling said piezoelectric means and said laser transmitter means.

2. A laser weapon simulator according to claim 1, comprising:

said laser transmitter means being a laser diode; and said circuit means including a silicon controlled rectifier providing a power signal from said piezoelectric means to said laser diode.

3. A laser weapon simulator for emitting an output signal in response to a blank cartridge being fired, comprising:

piezoelectric means solely providing electrical power and control signals to a laser transmitter in response to an explosion of a blank cartridge being fired by a weapon;

housing means being coaxially aligned to the barrel of a weapon for housing said piezoelectric means, said housing means providing an exit port for gasses generated by a blank cartridge being fired, said housing for transmitting an explosion of a blank cartridge to said piezoelectric means;

laser transmitter means providing an output signal in response to said electrical power and control signals from said piezoelectric means, said laser transmitter means being coaxially aligned with the barrel of a weapon and being disposed in said housing means; and circuit means coupling said piezoelectric means and said laser transmitter means for conducting electrical power and control signals from said piezoelectric means to said laser transmitter means.

4. A laser weapon simulator for emitting an output signal in response to firing a blank cartridge, comprising:

piezoelectric means solely providing electrical power and control signals to a laser transmitter in response to the sound wave generated by a blank cartridge being fired;

housing means being coaxially aligned to the barrel of a weapon for transmitting a sound wave of a blank cartridge being fired to said piezoelectric means, said housing means providing an exit port for gasses generated by a blank cartridge being fired and housing said piezoelectric means;

a capacitor coupled to said piezoelectric means, and being charged by said piezoelectric means;

switching means having a current path and a control electrode, said current path coupled to said capacitor for discharging said capacitor through laser transmitter means in response to a control signal from said piezoelectric means;

means coupling said piezoelectric means with said control electrode of said switching means;

laser transmitter means providing an output signal in response to said electrical power and control signals from said piezoelectric means, said laser transmitter being coaxially aligned with the barrel of a weapon and being disposed in said housing means; said laser transmitter means providing an output signal in response to said capacitor being discharged; and lens means optically coupled to said laser transmitter means.

* * * * *